US008075703B2

(12) United States Patent
Avoyan et al.

(10) Patent No.: US 8,075,703 B2
(45) Date of Patent: Dec. 13, 2011

(54) IMMERSIVE OXIDATION AND ETCHING PROCESS FOR CLEANING SILICON ELECTRODES

(75) Inventors: Armen Avoyan, Glendale, CA (US); Duane Outka, Fremont, CA (US); Catherine Zhou, Fremont, CA (US); Hong Shih, Walnut, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

(21) Appl. No.: 12/635,167

(22) Filed: Dec. 10, 2009

(65) Prior Publication Data

US 2010/0139692 A1 Jun. 10, 2010

Related U.S. Application Data

(60) Provisional application No. 61/121,353, filed on Dec. 10, 2008.

(51) Int. Cl.

| | |
|---|---|
| ***B08B 3/12*** | (2006.01) |
| ***B08B 3/08*** | (2006.01) |
| ***B08B 3/04*** | (2006.01) |

(52) U.S. Cl. ..... 134/28; 134/1.3; 134/26; 134/29

(58) Field of Classification Search ..... None
See application file for complete search history.

(56) References Cited

U.S. PATENT DOCUMENTS 5,409,569 A * 4/1995 Seki et al. ..... 216/99
5,651,836 A * 7/1997 Suzuki ..... 134/34
5,722,877 A 3/1998 Meyer et al.
5,837,662 A * 11/1998 Chai et al. ..... 510/175
6,012,470 A 1/2000 Jones
6,024,107 A 2/2000 Jones
6,073,577 A 6/2000 Lilleland et al.
6,108,091 A 8/2000 Pecen et al.
(Continued)

FOREIGN PATENT DOCUMENTS

JP 7066180 A 3/1995
(Continued)

OTHER PUBLICATIONS

Handbook of Semiconductor Wafer Cleaning Technology, Ed. W. Kern, © 1993, Noyes Publications, p. 137.*
(Continued)

*Primary Examiner* — Michael Barr
*Assistant Examiner* — Caitlin N Dennis
(74) *Attorney, Agent, or Firm* — Dinsmore & Shohl LLP

(57) ABSTRACT

A process for cleaning a silicon electrode is provided where the silicon electrode is soaked in an agitated aqueous detergent solution and rinsed with water following removal from the aqueous detergent solution. The rinsed silicon electrode is then soaked in an agitated isopropyl alcohol (IPA) solution and rinsed. The silicon electrode is then subjected to an ultrasonic cleaning operation in water following removal from the IPA solution. Contaminants are then removed from the silicon electrode by soaking the silicon electrode in an agitated mixed acid solution comprising hydrofluoric acid, nitric acid, acetic acid, and water. The silicon electrode is subjected to an additional ultrasonic cleaning operation following removal from the mixed acid solution and is subsequently rinsed and dried. In other embodiments of the present disclosure, it is contemplated that the silicon electrode can be soaked in either the agitated aqueous detergent solution, the agitated isopropyl alcohol (IPA) solution, or both. Additional embodiments are contemplated, disclosed, and claimed.

21 Claims, 8 Drawing Sheets

U.S. PATENT DOCUMENTS

| | | | | |
|---|---|---|---|---|
| 6,111,634 | A | 8/2000 | Pecen et al. | |
| 6,132,289 | A | 10/2000 | Labunsky et al. | |
| 6,148,765 | A | 11/2000 | Lilleland et al. | |
| 6,194,322 | B1 | 2/2001 | Lilleland et al. | |
| 6,213,136 | B1 | 4/2001 | Jones | |
| 6,245,192 | B1 | 6/2001 | Dhindsa et al. | |
| 6,258,228 | B1 | 7/2001 | Reiss | |
| 6,325,948 | B1 | 12/2001 | Chen et al. | |
| 6,358,118 | B1 | 3/2002 | Boehm et al. | |
| 6,376,385 | B2 | 4/2002 | Lilleland et al. | |
| 6,488,568 | B1 | 12/2002 | Treur et al. | |
| 6,506,254 | B1 | 1/2003 | Bosch et al. | |
| 6,538,387 | B1 | 3/2003 | Seki et al. | |
| 6,561,870 | B2 | 5/2003 | Saldana et al. | |
| 6,599,765 | B1 | 7/2003 | Boyd et al. | |
| 6,612,904 | B1 | 9/2003 | Boehm et al. | |
| 6,621,584 | B2 | 9/2003 | Pecen et al. | |
| 6,712,679 | B2 | 3/2004 | Taylor et al. | |
| 6,729,945 | B2 | 5/2004 | Xu et al. | |
| 6,752,898 | B1 | 6/2004 | Anderson, II et al. | |
| 6,766,679 | B1 | 7/2004 | Judd et al. | |
| 6,769,970 | B1 | 8/2004 | Taylor et al. | |
| 6,776,695 | B2 | 8/2004 | Owczarz et al. | |
| 6,790,128 | B1 | 9/2004 | Taylor et al. | |
| 6,887,338 | B1 | 5/2005 | Taylor | |
| 6,896,586 | B2 | 5/2005 | Pham et al. | |
| 6,913,521 | B2 | 7/2005 | Owczarz et al. | |
| 6,953,515 | B2 | 10/2005 | Boyd et al. | |
| 6,955,588 | B1 | 10/2005 | Anderson, II et al. | |
| 6,976,906 | B2 | 12/2005 | Boyd et al. | |
| 6,988,934 | B1 | 1/2006 | Lee et al. | |
| 6,991,512 | B2 | 1/2006 | Taylor et al. | |
| 7,018,273 | B1 | 3/2006 | Kiermasz et al. | |
| 2002/0151256 | A1 | 10/2002 | Taylor et al. | |
| 2003/0032379 | A1 | 2/2003 | Taylor et al. | |
| 2003/0087195 | A1* | 5/2003 | Kim et al. | 430/313 |
| 2003/0186623 | A1 | 10/2003 | Pham et al. | |
| 2003/0205325 | A1 | 11/2003 | Boyd et al. | |
| 2004/0067720 | A1 | 4/2004 | Boyd et al. | |
| 2004/0235399 | A1 | 11/2004 | Owczarz et al. | |
| 2005/0241765 | A1 | 11/2005 | Dhindsa et al. | |
| 2006/0138081 | A1 | 6/2006 | Huang et al. | |
| 2006/0141787 | A1 | 6/2006 | Ren et al. | |
| 2006/0141802 | A1* | 6/2006 | Shih et al. | 438/753 |
| 2007/0068629 | A1 | 3/2007 | Shih et al. | |
| 2007/0235660 | A1 | 10/2007 | Hudson | |
| 2007/0284246 | A1 | 12/2007 | Keil et al. | |
| 2008/0015132 | A1 | 1/2008 | Ren et al. | |
| 2008/0092920 | A1* | 4/2008 | Shih et al. | 134/1 |
| 2008/0160858 | A1 | 7/2008 | Paolucci et al. | |
| 2008/0236620 | A1* | 10/2008 | Shih et al. | 134/9 |

FOREIGN PATENT DOCUMENTS

| | | | |
|---|---|---|---|
| JP | 7155969 | A | 6/1995 |
| JP | 11087324 | A | 3/1999 |
| JP | 2000164395 | A | 6/2000 |
| KR | 20020043702 | A | 6/2002 |

OTHER PUBLICATIONS

Handbook of Semiconductor Wafer Cleaning Technology, Ed. W. Kern, © 1993, Noyes Publications, pp. 24, 137.*

Fisher Container Corp., Cleanroom Packaging, Feb. 18, 2007, URL: http://replay.waybackmachine.org/20070218110250/http://www.fishercontainer.com/cleanroom.htm.*

Internatioal Search Report and Written Opinion dated Feb. 24, 2010 pertaining to International Application No. PCT/US2009/048794.

International Search Report and Written Opinion dated Jun. 24, 2010 pertaining to International application No. PCT/US2009/067494.

International Search Report and Written Opinion dated Jul. 1, 2010 pertaining to International application No. PCT/US2009/067495.

* cited by examiner

IMMERSIVE OXIDATION AND ETCHING PROCESS FOR CLEANING SILICON ELECTRODES

CROSS-REFERENCE TO RELATED APPLICATIONS

This application claims the benefit of U.S. Provisional Application Ser. No. 61/121,353, filed Dec. 10, 2008. This application is related to commonly assigned copending U.S. patent application Ser. No. 12/635,175, filed on the same date as the present application.

SUMMARY

The present disclosure relates generally to processes for electrode reconditioning and, more particularly, to processes for reconditioning single and multi-component electrodes that have been used as excitation electrodes in plasma processing systems. Although the processes of the present disclosure are not limited to particular electrode configurations or the context in which the electrodes have been used prior to reconditioning, for the purposes of illustration, the process steps are illustrated herein with reference to the specific silicon-based electrode assemblies illustrated in FIGS. 8-11. It is contemplated that the processes of the present disclosure will also enjoy utility in reconditioning other types of electrodes, including monoelectrodes, where the inner and outer electrodes are integrated as a single piece electrode, and other electrode configurations that are structurally similar to or distinct from the electrodes illustrated herein.

In the embodiment illustrated in FIGS. 8-11, the inner electrode comprises a plurality of gas holes that extend through the thickness of the electrode and can be placed in fluid communication with a process gas feed. Although the gas holes can be arranged in a variety of different manners, in the illustrated embodiment, the gas holes are arranged in concentric circles, extending radially outward from the center of the inner electrode, and circumferentially spaced throughout the concentric circles. Similarly, single piece, monoelectrodes may also be provided with a plurality of gas holes.

In accordance with one embodiment of the present disclosure, a process for cleaning a silicon electrode is provided where the silicon electrode is soaked in an agitated aqueous detergent solution and rinsed with water following removal from the aqueous detergent solution. The rinsed silicon electrode is then soaked in an agitated isopropyl alcohol (IPA) solution and rinsed. The silicon electrode is then subjected to an ultrasonic cleaning operation in water following removal from the IPA solution. Contaminants are then removed from the silicon electrode by soaking the silicon electrode in an agitated mixed acid solution comprising hydrofluoric acid, nitric acid, acetic acid, and water. The composition of the mixed acid solution is formulated to permit electrode cleaning through immersive oxidation and etching of the silicon electrode. The silicon electrode is subjected to an additional ultrasonic cleaning operation following removal from the mixed acid solution and is subsequently rinsed and dried. In other embodiments of the present disclosure, it is contemplated that the silicon electrode can be soaked in either the agitated aqueous detergent solution, the agitated isopropyl alcohol (IPA) solution, or both. Additional embodiments are contemplated, disclosed, and claimed.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
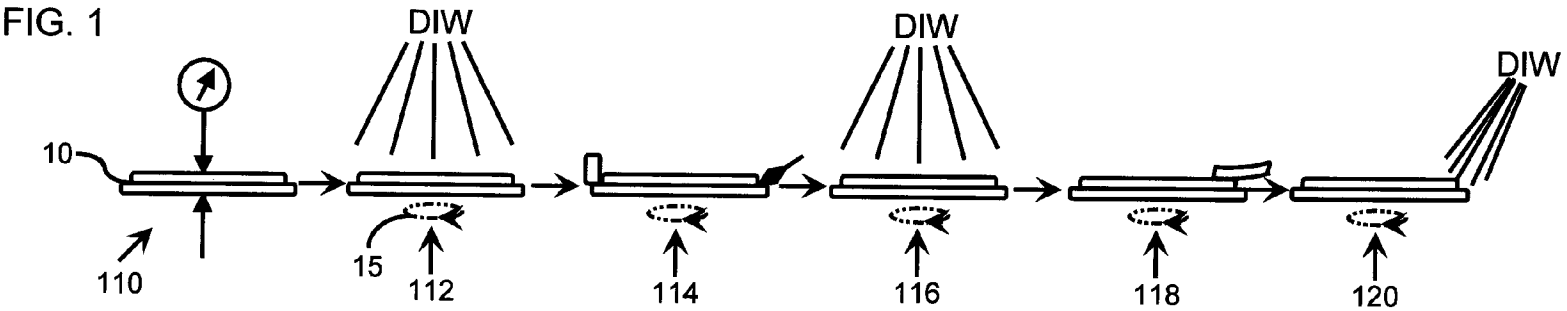
FIGS. 1-3 illustrate a process for polishing a first type of silicon electrode according to the present disclosure.

FIGS. 1-5 illustrate a method of polishing a silicon electrode. Referring to FIG. 1, in one embodiment, the method may include a prepolishing measurement step 110. For the measurement of the surface roughness of the inner electrode 10, first measure the center of the inner electrode. Then, measure four points 90° apart from one another, at ½ of the radius from the center measurement. It is contemplated that other forms of surface roughness measurement may be conducted. Furthermore, it is contemplated that the pre-polishing measurement step need not be conducted.

Further referring to FIG. 1, in one embodiment, the inner electrode pre-polishing measurement step 110 may include measuring the thickness profile of the inner electrode 10. Preferably, the thickness of the inner electrode 10 is measured at eighteen points along the diameter, starting at the very edge and the first row of gas holes and extending to the opposing side of the inner electrode. However, other methods of thickness measurement are contemplated. In order to calculate the inner electrode thickness profile, total the 18 measurements, and calculate the average thickness. Preferably, the average calculated thickness is larger than the minimum allowable electrode thickness. Also, it is contemplated that no prepolishing measurement is conducted.

Further referring to FIG. 1, optionally, after the inner electrode prepolishing measurement step 110 has been completed, both the turntable 15 and platen adapter 60 (see FIG. 15) should be cleaned and tested for proper functionality. Preferably, all holding equipment should be cleaned with the following sequence: wiped with Isopropyl Alcohol (IPA), then rinsed with Deionized water (DIW); then wiped with 2% $HNO_3$ solution, and then rinsed with DIW. This cleaning sequence should be re-cleaned each time they are used in the polishing procedure to avoid any contamination/cross-contamination of the electrode with polishing residue. However, other suitable cleaning protocols may used to remove dirt before the polishing process begins.

After preparation, the inner electrode 10 should be mounted firmly on a platen adapter 60 (see FIG. 15) using center and guide pins to ensure engagement with the platen adapter 60, or on any suitable polishing structure in preparation for the polishing process.

Referring again to FIG. 1, in order to remove sidewall deposits from the inner electrode 10, a first sidewall rinsing step 112 is provided. In one embodiment, the sidewall rinsing step 112 comprises rinsing the inner electrode 10 with DIW. Preferably, the flow of DIW should be kept constant during the entire polishing procedure. During the first sidewall rinsing step 112, the turntable 15 may be rotated at a speed ranging from approximately 20 to 40 rpm. However, it is contemplated that the turntable 15 may be rotated at other speeds.

Figure 10:
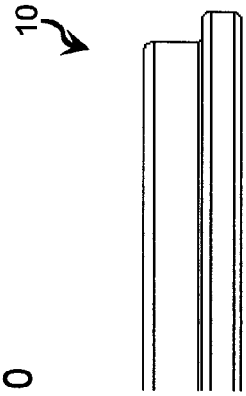
FIGS. 10-11 present edgewise views of the individual electrode components of FIGS. 8-9.

Further referring to FIG. 1, from the first sidewall rinsing step 112, the inner electrode 10 may also be processed with a sidewall polishing step 114. In one embodiment, the sidewall polishing step 114 comprises polishing both the sidewall and step surfaces of the inner electrode 10 (see FIG. 10). In one embodiment, diamond grit pads and diamond tips may be used to polish the sidewall and step surfaces. Alternatively, other abrasive materials may also be used to conduct the polishing and remove the sidewall deposits. Preferably, polishing time may range between 1 and 2 minutes to completely remove the sidewall deposits. However, as is contemplated, the polishing step may take more or less time.

After the sidewall polishing step 114, the inner electrode 10 may be treated with a second sidewall rinsing step 116. In one embodiment, the second sidewall rinsing step 116 comprises rinsing the inner electrode 10 with DIW until there are no sidewall deposits remaining. In one embodiment, the rinsing lasts for 1-2 minutes. However, length of the second sidewall rinsing step 116 may be shortened or lengthened depending on the needs of the particular application.

After the second sidewall rinsing step 116, the inner electrode 10 may undergo a sidewall wiping step 118. In one embodiment, the side wall wiping step 118 comprises wiping both the sidewall and step surfaces with a cleanroom wipe to remove all residual sidewall deposits. However, the side wall wiping step 118 may also comprise other means of removing the residual deposits, such as alternative wiping methods, and cleaning devices.

In one configuration of the method, after the side wall wiping step 118, the inner electrode 10 may undergo a magnum rinsing step 120. In one embodiment, the magnum rinsing step 120 comprises rinsing the inner electrode 10 with DIW. Preferably, the magnum rinsing step 120 lasts for at least one minute. However, the duration of the magnum rinsing step 120 may be modified.

Figure 2:
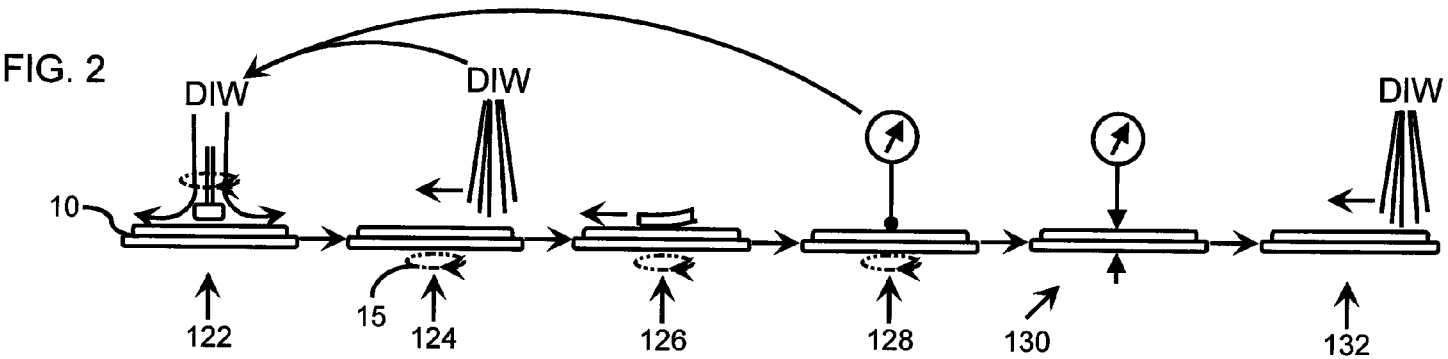
Figure 8:
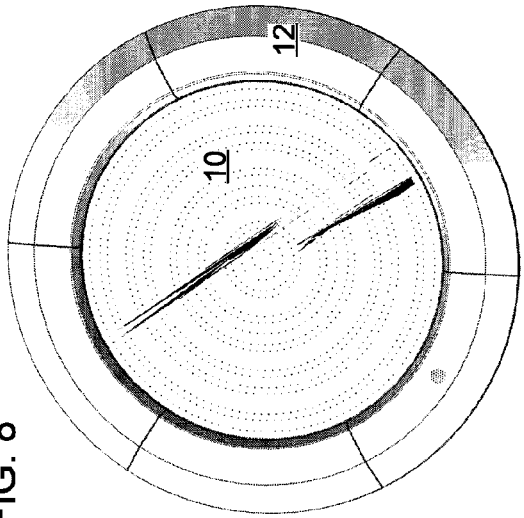
FIGS. 8 and 9 present frontside and backside views of a silicon electrode assembly.

After the sidewall polishing of the inner electrode 10 has been completed, the remaining surfaces of the inner electrode 10 may be polished. Referring to FIG. 2, the inner electrode 10 may first undergo polishing of the flat electrode surface. In one embodiment, the inner electrode 10 may undergo a scrub polishing step 122 to polish the flat electrode surface of the inner electrode 10 (see FIG. 8). In one embodiment, the scrub polishing step 122 comprises polishing the inner electrode 10 with successively finer diamond disks, while continually rinsing the inner electrode 10 with DIW.

In one embodiment, the inner electrode 10 is rotated at a speed ranging from between 80 to 120 rpm using the turntable 15. It is contemplated that the turntable 15 may also be rotated at other speeds. In one embodiment, a flat polishing disk may be used for the scrub polishing step 122, if it is kept flat on the surface of the inner electrode 10. If the firm handle that is connected to the polishing disk becomes soft and cannot maintain the flatness, it should be replaced with a new handle immediately. Additionally, other polishing devices may be used.

In one embodiment, successively finer diamond disks may be used to complete the scrub polishing step 122. If the inner electrode 10 has minor roughening and pits, a 180 grit diamond disk may be used to begin the scrub polishing step 122. If the inner electrode 10 has a roughened surface with deep pitting or scratches, a 140 grit diamond disk may be used to start the scrub polishing step 122. Preferably, the scrub polishing step 122 should be started with coarse diamond disks until the major pits, scratches, and surface damage has been removed. Once the major damage has been polished out, the surface of the inner electrode 10 may be uniform in color.

In another embodiment, after polishing the surface by the first selected diamond disk, the inner electrode 10 may be polished with a higher grit diamond disk, such as 180, 220, 280, 360, and 800 grit diamond disk. Preferably, during the scrub polishing step 122, a uniform pressure should be applied to the diamond disk.

In yet another embodiment, whenever a diamond disk is changed, the inner electrode 10 should be rinsed with DIW for at least one minute to remove accumulated particles. However, the inner electrode 10 may undergo rinsing for a wide range of durations to remove accumulated particles.

After each diamond disk is changed, the inner electrode 10 may undergo a magnum rinsing step 124 to remove any trapped particles inside the gas holes on the inner electrode 10. In one embodiment, the magnum rinsing step 124 comprises rinsing the inner electrode 10 with a magnum gun to remove any by-products that accumulate. In another embodiment, the magnum rinsing step 124 is conducted with DIW and either 40 psi $N^2$ or clean dry air.

After the magnum rinsing step 124, the inner electrode 10 may undergo a wiping step 126 to remove excess water from the silicon surface. In one embodiment, the wiping step 126 comprises wiping the surfaces of the inner electrode 10 with a cleanroom wipe. However, it is contemplated that other water removal steps may be utilized.

After the wiping step 126, a post-polishing measuring step 128 may be conducted to assess the surface roughness of the inner electrode 10 in accordance with the procedure applied in the inner electrode prepolishing measure step 110 discussed above. However, the surface roughness may also be assessed in an other suitable manner. In one embodiment, if the surface roughness of the inner electrode 10 is greater than 8μ inches Ra, then the inner electrode 10 should be returned to the scrub polishing step 122 until the appropriate surface roughness is reached. However, it is contemplated that other roughnesses may be appropriate.

In one embodiment, if the post-polishing measuring step 128 reveals that the inner electrode 10 is within an appropriate surface roughness range, a final thickness measurement step 130 may be conducted to assess the thickness of the inner electrode 10, in the same manner as the inner electrode prepolishing measurement step 110. The thickness of the inner electrode 10 may also be compared to the minimum thickness specification for the inner electrode 10. However, it is also contemplated that no measurement step may necessary in all embodiments.

After the final thickness measurement step 130 is completed, the inner electrode 10 may undergo a final polishing step 132 to remove the marks created by surface roughness and thickness profile measurements. In one embodiment, the final polishing step 132 comprises rinsing with DIW, lightly polishing to remove measurement marks, and spray rinsing the inner electrode 10. Preferably, the rinsing with DEW has a duration of at least one minute, however, alternative durations are also contemplated. Furthermore, in one embodiment, the light polishing step may last only 2-3 minutes, however, different durations are contemplated. Preferably, the spray rinsing of the inner electrode 10 is conducted with DIW, for only 1-2 minutes. However, both shorter and longer rinsing times are contemplated.

Figure 3:
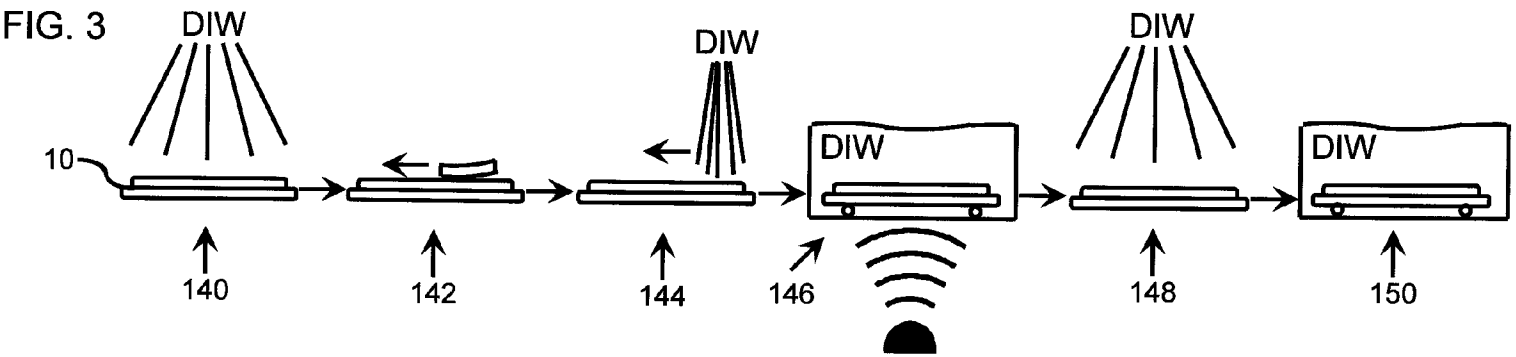
Figure 16:
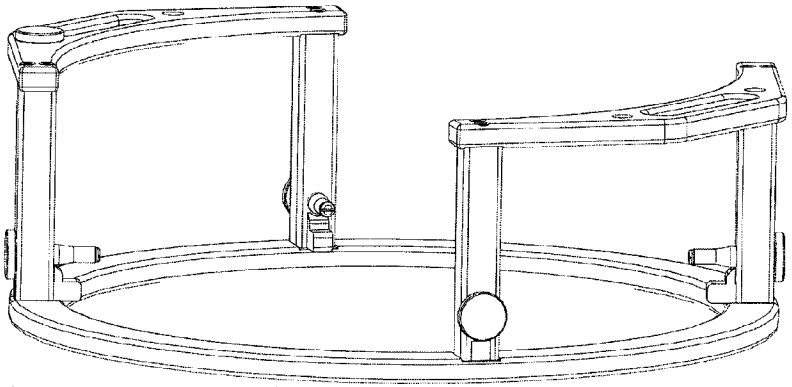
FIG. 16 illustrates an electrode fixture.
Figure 17:
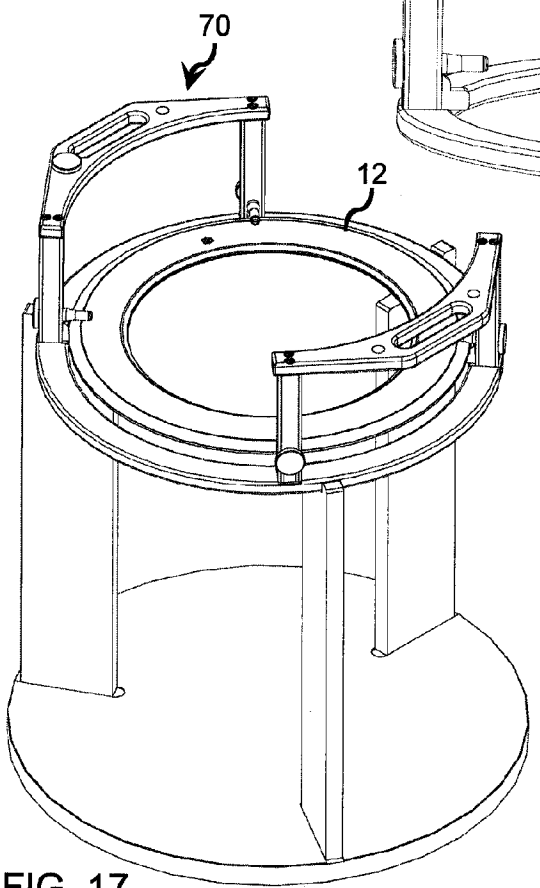
FIGS. 17-18 illustrate two different types of silicon electrodes supported by the electrode fixture of FIGS. 15 and 16.
Figure 18:
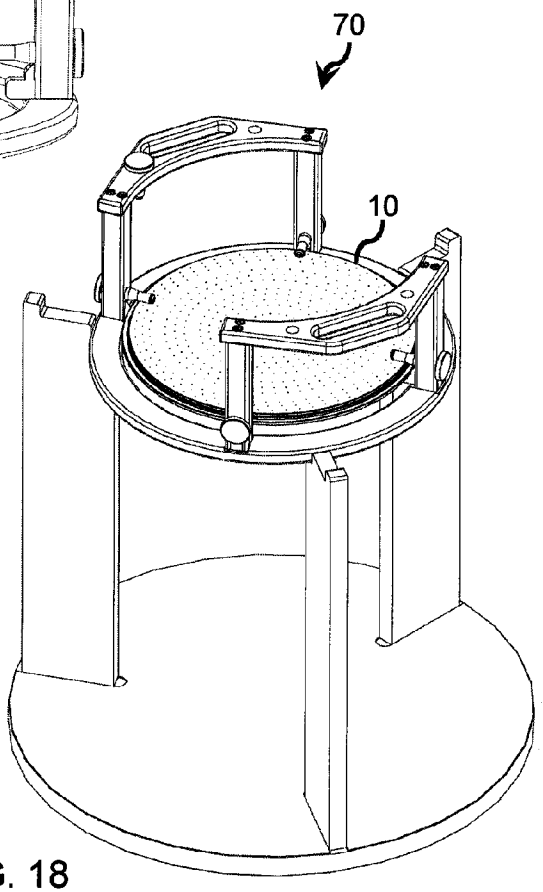

Referring to FIG. 3, after the final polishing step 132 is completed, the inner electrode 10 is removed from the platen adapter 60, and is mounted on a fixture 70 (see FIGS. 16-18 for examples of suitable rinsing fixtures). Upon mounting on a fixture 70, the inner electrode 10 undergoes a rinsing step 140. In one embodiment, the rinsing step 140 comprises rinsing the inner electrode 10 with DIW and $N^2$ or clean dry air at 40-50 psi. Preferably, the rinsing step 140 has a duration of at least five minutes. However, it is contemplated that the rinsing step 140 may last shorter or longer depending on the needs of the application.

After the rinsing step 140 is completed, the inner electrode 10 is rinsed with DIW and undergoes a final wiping step 142. In one embodiment, the final wiping step 142 comprises wiping off the inner electrode 10 surface until all smut and excess water is removed from the inner electrode 10.

After the final wiping step 142, the inner electrode 10 undergoes a final magnum rinse step 144. In one embodiment, the final magnum rinse step 144 comprises rinsing the inner electrode 10 with DIW. Preferably, the final magnum rinse step 144 has a duration of at least five minutes, but other rinse durations are contemplated.

After the final magnum rinse step 144, the inner electrode 10 undergoes an ultrasonic cleaning step 146. In one embodiment, the ultrasonic cleaning step 146 comprises ultrasonically cleaning the inner electrode 10, while flowing ultra pure water (UPW) directly into a liner. Preferably, the inner electrode is kept front side up, and the ultrasonic cleaning step 146 has a duration of 10 minutes. However, the ultrasonic cleaning step 146 may last longer or shorter than ten minutes. The inner electrode 10 may be rotated periodically during the ultrasonic cleaning step 146, for example, every five minutes.

After the ultrasonic cleaning step 146, the inner electrode 10 undergoes a final spray rinsing step 148. In one embodiment, the final spray rinsing step 148 comprises spray rinsing the inner electrode 10 with DIW. In one embodiment, the final spray rinsing step 148 lasts at least one minute. However, the final spray rinsing step 148 may last shorter or longer than one minute. In another embodiment, the inner electrode 10 may be inspected to make sure that there are no chips, cracks, and/or damage on both the front and back side of the electrode.

In another embodiment, the inner electrode 10 may undergo a soaking step 150. The soaking step 150 may comprise placing the inner electrode 10 into a polypropylene or a polyethylene tank filled with DIW. In one embodiment, after the inner electrode 10 enters the soaking step 150, the inner electrode 10 must undergo the cleaning method described below within two hours.

Figure 4:
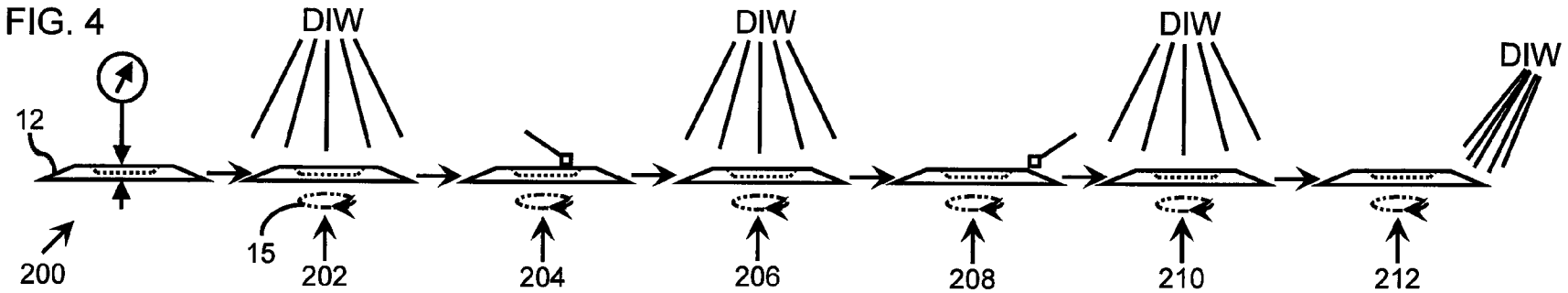
FIGS. 4 and 5 illustrate a process for polishing a second type of silicon electrode according to the present disclosure.

Referring to FIG. 4, in one embodiment, the outer electrode pre-polishing measurement step 200 may include measuring both the thickness and surface roughness of the outer electrode 12. Preferably, to measure the surface roughness of the outer electrode 12, measure six points on the top flat surface. One point should be aligned with the serial number of the outer electrode 12. The remaining five points should be uniformly distributed around the top flat surface, at radii equidistant around the outer electrode 12. However, other means of measuring the surface roughness of the outer electrode 12 may also be used. Furthermore, it is contemplated that no pre-polishing measurement is needed.

In one embodiment, the thickness of the outer electrode 12 may be measured. Preferably, six measurements may be taken of the flat top surface of the outer electrode 12, each at a substantially similar radius as the next measurement. An average of the six measurements may be taken, and averaged. The average may be compared against the minimum allowable outer electrode thickness specification. However, other methods of calculating the thickness of the outer electrode 12 may also be used. Furthermore, it is contemplated that no pre-polishing measurement is needed.

Further referring to FIG. 4, for the outer electrode pre-polishing measurement step 200, in one embodiment, the profile of the cross-sectional outer electrode 12 may be measured. Preferably, the silicon piece opposite to the WAP holes is measured to determine the cross-section profile measurement. Eight points along the surface may be measured at points substantially equidistant from one another along a straight line radiating from the center of the outer electrode 12, starting from the outer edge of the top flat surface, and extending inwards towards the inner edge, with the final measurement taken before the inner edge.

Figure 13:
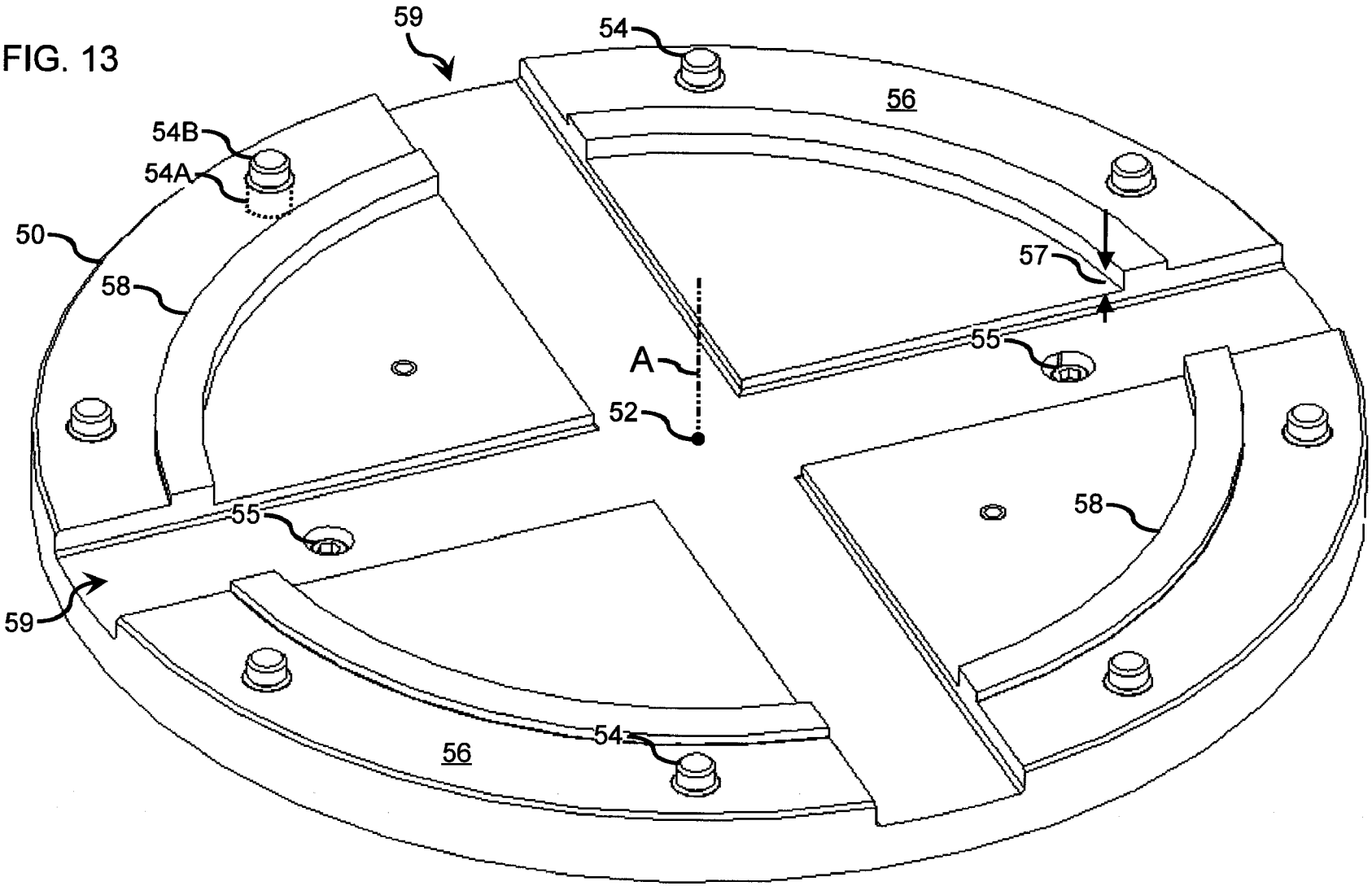
FIG. 13 illustrates an electrode platen according to the present disclosure.

After the outer electrode pre-polishing measurement step 200, in one embodiment, the outer electrode 12 may be mounted to the dual function electrode platen 50 with at least two threaded electrode mounts 54 for quick engagement with the dual function electrode platen 50 (see FIG. 13). In another embodiment, the dual function electrode platen 50 may be mounted on a turn table 15, which may be configured to rotate at a speed between approximately 80 and 120 rpm, with both forward and backward rotation.

After mounting on the dual function electrode platen 50, the outer electrode 12 undergoes a first rinsing step 202, which comprises rinsing the outer electrode 12 with DIW. Preferably, during the first rinsing step 202, the turntable 15 is rotated at a speed of 20 to 40 rpm, but other rotation speeds are also contemplated.

Figure 11:
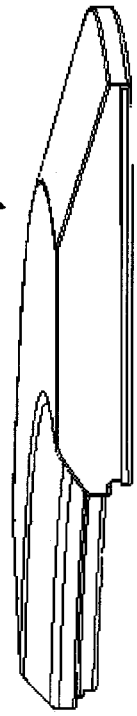

After the first rinsing step 202, the outer electrode 12 may undergo an inner diameter polishing step 204. The inner diameter polishing step 204 may comprise polishing the inner diameter of the outer electrode 12 (see FIG. 11). In one embodiment, diamond pads may be used to polish and remove any inside diameter sidewall deposits. Preferably, 800 grit diamond pads may be used, but other abrasive materials are contemplated. In one embodiment, the inner diameter polishing step 204 may take 1-2 minutes of polishing time to remove the sidewall deposition completely.

After the inner diameter polishing step 204 is completed, the outer electrode 12 may undergo an inner diameter rinsing step 206. In one embodiment, the inner diameter rinsing step 206 comprises rinsing the outer electrode 12 with DIW. Preferably, the inner diameter rinsing step 206 comprises rinsing the sidewall for 1-2 minutes, and wiping the sidewall to remove any residual deposition. The outer electrode 12 may also be inspected to ensure that there is no sidewall deposition remaining.

After the inner diameter rinsing step 206 is completed, the outer electrode 12 may undergo an outer diameter polishing step 208. The outer diameter polishing step 208 may comprise polishing the outer diameter sidewall to remove any sidewall deposition (see FIG. 11). Preferably, 800 grit diamond pads may be used to polish the outer electrode 12. However, other abrasive devices may be used to polish the outer diameter. Furthermore, the sidewall deposit may take 1-2 minutes of polishing time to completely remove, but longer removal times are contemplated.

Once the outer diameter polishing step 208 has been completed, the outer electrode 12 may undergo an outer diameter rinsing step 210. In one embodiment, the outer diameter rinsing step 210 comprises rinsing the outer diameter of the outer electrode 12 with DIW (See FIG. 11). Preferably, the outer diameter rinsing step 210 has a duration of at least one minute to remove any particles that may have accumulated. However, other durations of rinsing are also contemplated. In another embodiment, after the outer diameter rinsing step 210 has been completed, both the inside and outer diameter may be inspected to ensure that all deposits have been removed.

Upon completion of the outer diameter rinsing step 210, the outer electrode 12 may undergo a inner and outer diameter magnum rinsing step 212. In one embodiment, the inner and outer diameter magnum rinsing step 212 comprises rinsing the outer electrode 12 with DIW using a magnum gun rinse. Preferably, the outer diameter magnum rinsing step 212 has a duration of at least one minute each on the inner and outer edges of the outer electrode 12. However, other rinsing times are contemplated.

Figure 5:
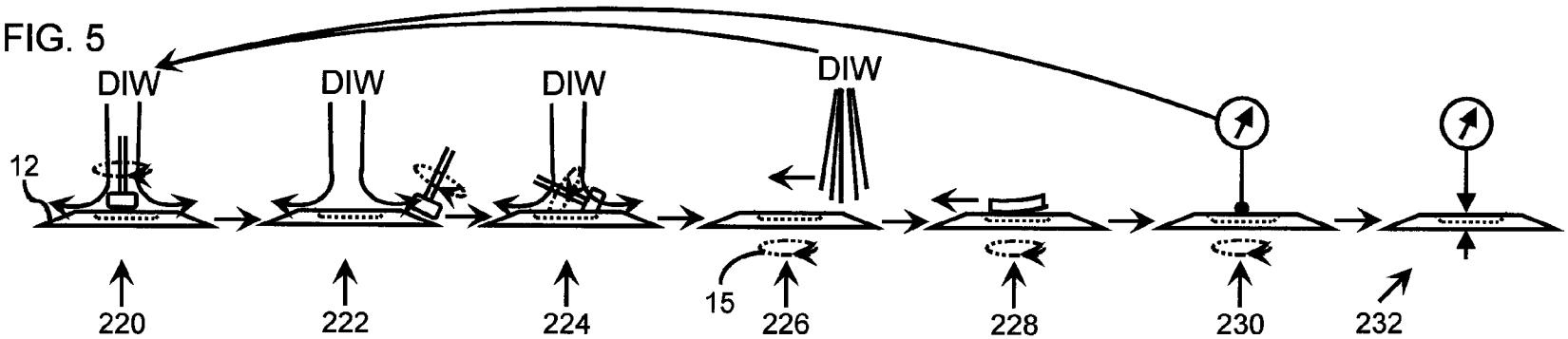

After the inner and outer diameter magnum rinsing steps are completed, the outer electrode 12 may undergo polishing of the remaining surfaces. Referring to FIG. 5, in one embodiment, the top flat surface is polished first, followed by the polishing of the outer sloped area, and finally, the inner sloped area is polished (see FIG. 11). Incorrect polishing techniques may result in the rounding of the edges, and a modification of the surface profile of the outer electrode 12. Furthermore, in one embodiment, the inner sloped area may not be polished while in the platen adapter 60

In one embodiment, the outer electrode 12 may undergo a flat top polishing step 220 to polish the flat electrode surface of the outer electrode 12. In one embodiment, the flat top polishing step 220 comprises polishing the outer electrode 12 with successively finer diamond disks, and continually rinsing the outer electrode 12 with DIW. However, other abrasion devices and protocols are contemplated.

Preferably, the outer electrode 12 is rotated at a speed ranging from between 80 to 120 rpm using the turntable 15. However, other rotation speeds are contemplated. In one embodiment of the flat top polishing step 220, a flat polishing disk may be used, and must be kept flat on the top surface of the outer electrode 12. If the firm handle connected to the polishing disk becomes soft and cannot maintain the flatness, it should be replaced with a new handle immediately. However, other polishing devices are contemplated for use in the flat top polishing step 220.

In one embodiment, coarser diamond disks may be used if the damage to the outer electrode 12 is extensive. For example, if the outer electrode 12 has minor roughening and pits, a 180 grit diamond disk may be used to begin the flat top polishing step 220. If the inner electrode 10 has a roughened surface with deep pitting or scratches, a 140 grit diamond disk may be used to start the flat top polishing step 220. The flat top polishing step 220 should be started with coarse diamond disks until the major pits, scratches, and surface damage has been removed. Preferably, once the major damage has been removed, the surface of the outer electrode 12 should be uniform in color.

In one embodiment, after polishing the surface with the first selected diamond disk, the electrode is polished with a higher grit diamond disk, such as 220, 280, 360, and 800 grit diamond disk. During the flat top polishing step 220, a uniform pressure should be applied to the diamond disk.

Whenever a diamond disk is changed, and a finer disk is used, an ultrasolv sponge may be used to remove particles that accumulate on the diamond disk after each polish. After each subsequent finer diamond disk polishing, the outer electrode 12 may undergo a water gun rinsing step 226. In one embodiment, the water gun rinsing step 226 comprises rinsing the outer electrode 12 with a water gun with DIW to reduce the number of trapped particles inside of the WAP holes on the outer electrode 12.

After the flat top polishing step 220 is completed, the outer electrode 12 may then undergo an outer surface polishing step 222. The outer surface polishing step 222 is conducted similarly to the flat top polishing 220 discussed above, where the outer surface polishing step 222 comprises polishing the outer electrode 12 with successively finer abrasion ratings, and continually rinsing the outer electrode 12 with DIW, except the outer surface of the outer electrode 12 is polished instead of the flat top surface (see FIG. 11).

After both the flat top polishing step 220 and the outer surface polishing step 222 are completed, the outer electrode 12 may undergo an inner surface polishing step 224. In one embodiment, the inner surface polishing step 224 comprises polishing the inner surface area of the outer electrode 12 (see FIG. 11). Preferably, a diamond disk is removed from the firm handle, and is used to gently polish the inner surface area. However, other means of polishing may be conducted instead. In one embodiment, the slope of the inner surface area should be kept unchanged. In another embodiment, the edges of the outer electrode 12 are not rounded off by polishing, and slope is left unchanged.

After the water gun rinsing step 226, the outer electrode 12 may be rinsed and wiped during an outer electrode wiping step 228. In one embodiment, the outer electrode wiping step 228 may comprise rinsing the outer electrode 12 with DIW, and wiping all excessive water from the silicon surface. However, other means of removing accumulated particles and moisture are contemplated.

After the outer electrode wiping step 228, an outer electrode quality measuring step 230 may be conducted to assess the surface roughness of the outer electrode 12 in accordance with the procedure applied in the pre-polishing measure step 110 disclosed above. In one embodiment, if the surface roughness of the outer electrode 12 is greater than 8μ inches Ra, then the outer electrode 12 should be returned to the polishing steps 220, 222, and 224 until the appropriate surface roughness is reached.

In one embodiment, if the outer electrode quality measuring step 230 reveals that the outer electrode 12 has a tolerable surface roughness, a final outer thickness measurement step 232 may be conducted to assess the thickness of the outer electrode 12, in the same manner as the outer electrode pre-polishing measurement step 200. The thickness measurement may be compared to a minimum thickness specification for the outer electrode 12.

After the outer electrode quality measuring step 230 is completed, the outer electrode 12 may undergo the steps disclosed in FIGS. 2 and 3 similar to the inner electrode 10, namely steps 132, 140, 142, 144, 146, 148, and 150, to complete the polishing process for the outer electrode 12.

In the context of monoelectrode polishing, a slope polishing tool 80 can be used to polish the inner slope, or other sloped surfaces, of the monoelectrode. In which case, the monoelectrode can be mounted on a turntable 15 and the slope polishing tool 80 is used to polish the inner slope. Preferably, the polishing tool 80 should be used with only 800 grit sandpaper, and it should be polished for at least two minutes until all stains are removed. However, other abrasion techniques and polishing durations are contemplated. In another embodiment, the polishing tool 80 should be kept straight at all times, and the monoelectrode should be rinsed after each stop.

Figure 6:
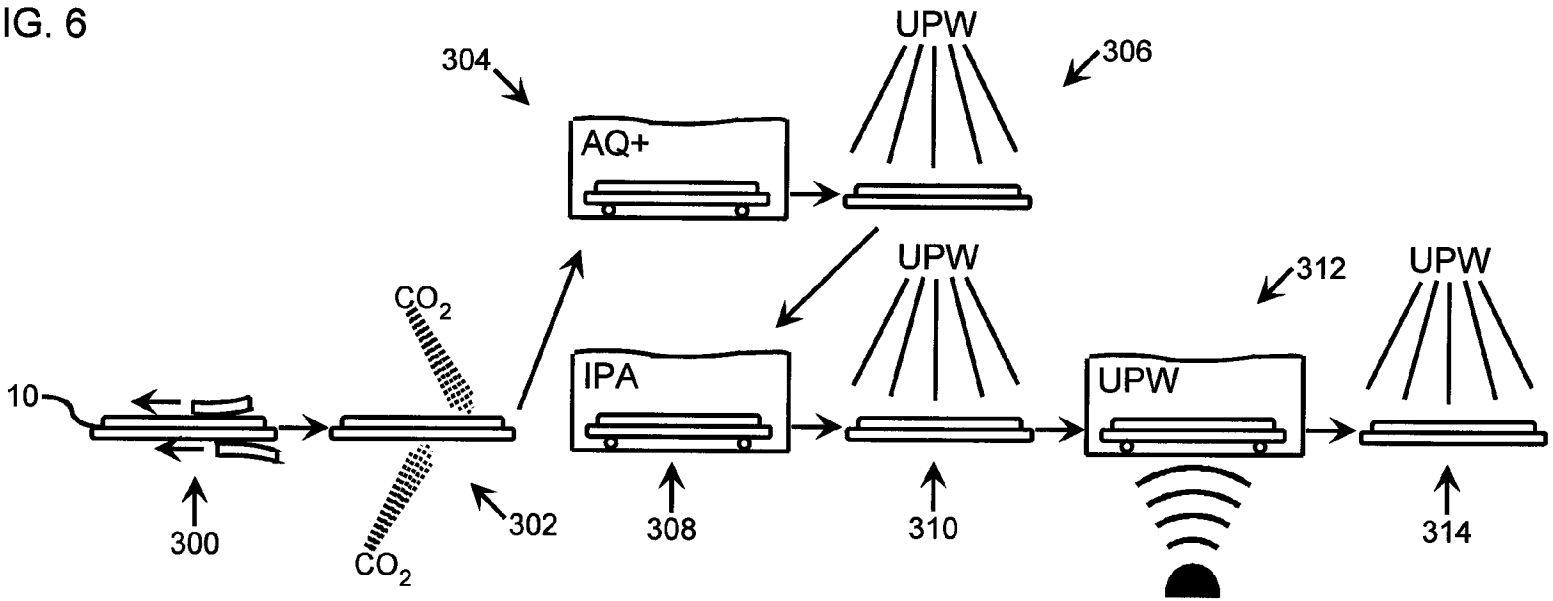
FIGS. 6 and 7 illustrate a process for cleaning a silicon electrode.
Figure 7:
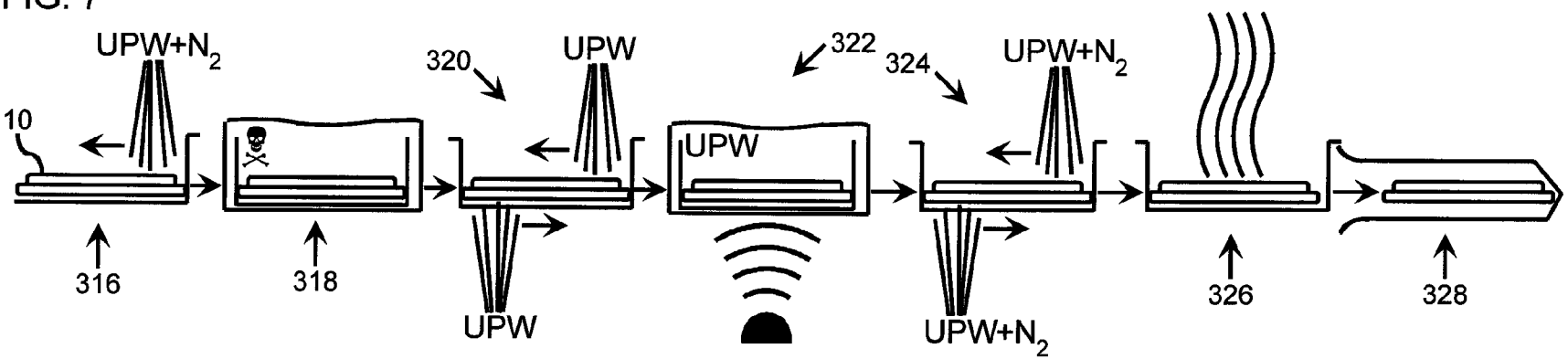
Figure 12:
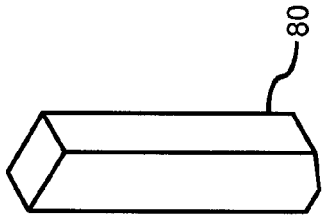
FIG. 12 illustrates a polishing tool.

Referring generally to FIGS. 6 and 7, a mixed acid cleaning process may be used to clean a variety of silicon electrode types, including, but not limited to, all of the electrode types discussed above. Furthermore, the mixed acid cleaning method may be used to clean other types and configurations of silicon electrodes that have not been disclosed.

The mixed acid cleaning process discussed below may be utilized after the polishing process is completed as described above, or the mixed acid cleaning process may be used independently of the polishing method. Furthermore, it is contemplated that certain cleaning and/or polishing steps may be omitted in light of the combination of various cleaning and polishing steps.

The mixed acid cleaning method discussed below is particularly advantageous since it does not require operator contact with the silicon electrode. As a result, although the mixed acid cleaning methodology of the present disclosure can incorporate steps that involve operator contact, it is generally a process that can be executed with a significant reduction in process variables that would otherwise arise from operations like non-automated polishing, manual wiping, manual spraying, etc. Furthermore, silicon electrodes should be handled with great caution and care, and all surrounding areas should be kept clean and free of unnecessary dirt. Silicon electrodes should be handled with a new pair of clean room gloves.

Referring to FIG. 6, in one embodiment, the process for cleaning a silicon electrode comprises a light up removal step 300 used to remove backside light up marks on the electrode. In one embodiment, the light up removal step 300 comprises masking designated zones, and scrubbing to remove any backside light up marks. Preferably, the electrode is placed on a sheet of Styrofoam. In another embodiment, the light up removal step 300 comprises masking the areas around any gas holes and concentric radial areas that lack gas holes. Preferably, the light up marks may be scrubbed with a 1350 diamond disk or a 1350 diamond tip very gently and carefully for a couple of seconds until the masks are removed. However, other means may be used to remove the light up marks. The light up removal step 300 may also comprise removing the masking and wiping the taped areas using Isopropyl Alcohol (IPA), after removal of the light up marks.

In one embodiment, the process for cleaning a silicon electrode may comprise a $CO_2$ pellet cleaning step 302 after the light up removal step 300 in order to remove any residue from graphite gaskets on the back of electrodes, to remove deposits from the front side of parts for certain etch processes, and to ensure the holes are free of particles. In one embodiment, the $CO_2$ pellet cleaning step 302 comprises blasting the silicon surface of the electrode with dry ice pellets. Preferably, the air pressure $\leqq 40$ psi and the pellet feed rate $\leqq 0.3$ Kg/minute. However, other air pressures and feed rates may be used. In another embodiment, the entire silicon surface should be blasted with dry ice Pellets to remove any chamber deposition, covering the entire surface, including the edges. Furthermore, in yet another embodiment, the holes in the electrode may be blasted to clean the inside.

In another embodiment, the $CO_2$ pellet cleaning step 302 comprises blasting the back side may be blasted with dry ice pellets to remove any residue remaining from the gaskets. Preferably, after blasting is completed, the electrode should be warmed for inspection to remove fog and frost, and the electrode may be inspected to ensure that all deposition is removed. If some deposition was missed during the blasting process, additional blasting should continue until all deposition is removed.

Preferably, during the $CO_2$ pellet cleaning step 302, a plastic nozzle could be used to avoid metal contamination and scratching the electrode. However, other combinations of nozzles and air flow may be acceptable if they do not cause damage. Additionally, in yet another embodiment, during the $CO_2$ pellet cleaning step 302, the backside of the electrode must be protected by either holding it with a hand, placing it on a soft surface, or setting it on a stand, such as the rinsing fixture as shown in FIGS. 16-18.

Referring again to FIG. 6, preferably, the $CO_2$ cleaning step 302 takes approximately five minutes to clean the inner electrode 10 and approximately 15 minutes to complete blasting of the outer electrode 12. However, different times for $CO_2$ cleaning are contemplated, and may be used, as long as no damage is caused to the electrode.

If the $CO_2$ Pellet cleaning step 302 is not performed, a wipe and scrub step may be performed instead. In one embodiment, the wipe and scrub step may comprise wiping the entire surface of the party with a cleanroom wipe and Isopropyl Alcohol (IPA) for at least one minute to remove any loose deposition and fingerprints. In one embodiment, the wipe and scrub step may also comprise using a scrub pad as needed to remove any deposits and residue remaining from the gaskets, and the holes on the backside of the electrode.

After the $CO_2$ Pellet cleaning step 302 or alternatively, the wipe and scrub step, in one embodiment, the electrode may undergo an aqueous detergent soaking step 304. In one embodiment, the detergent soaking step 304 comprises soaking the electrode in an aqueous detergent solution. Preferably, the soaking is conducted for 10 minutes, but other soaking durations are contemplated. In one embodiment, during the detergent soaking step 304, the electrode may be rested on Teflon bars, and agitated periodically. However, the agitation may continuous, discontinuous, periodic, or aperiodic. Furthermore, the Teflon bars may instead be Teflon coated, or even Teflon encapsulated bars.

Referring again to FIG. 6, In one embodiment, after the detergent soaking step 304, the electrode may undergo a detergent rinsing step 306. The detergent rinsing step 306 may comprise spray rinsing the electrode with ultra pure water (UPW). Preferably, the detergent rinsing step 306 is conducted for at least two minutes, but other rinsing times are contemplated. Further more, when describing UPW throughout the description, it may comprise water with a purity characterized by an electrical resistivity of greater than 18 MΩ. However, other purity ratings are also contemplated for use as UPW.

In one embodiment, after the detergent rinsing step 306, the electrode may undergo an IPA soaking step 308. The IPA soaking step 308 may comprise soaking the electrode in IPA. Preferably, the IPA soaking step is conducted for 30 minutes. However, additional soaking times are contemplated ranging from 5 minutes to several hours. In one embodiment, the electrode rests on Teflon bars and is agitated periodically during the IPA soaking step 308. However, the agitation may continuous, discontinuous, periodic, or aperiodic. Furthermore, the Teflon bars may be Teflon coated, or even Teflon encapsulated bars.

In one embodiment, the silicon electrode cleaning process comprises an IPA rinsing step 310. The IPA rinsing step 310 may comprise spray rinsing the electrode with UPW. Preferably, the IPA rinsing step 310 is conducted for at least one minute, but other rinsing times are contemplated.

If the electrode was polished before entering the cleaning process, the electrode may undergo an ultrasonic cleaning step 312. In one embodiment, the ultrasonic cleaning step 312 comprises cleaning the electrode in an liner, with excess UPW pumped directly into the liner and allowed to overflow. Preferably, during the ultrasonic cleaning step 312, the electrode rests on two Teflon bars in the ultrasonic tank. Furthermore, the Teflon bars may be Teflon coated, or even Teflon encapsulated bars. The liner may comprise either polypropylene or polyethylene, or other suitable materials. The ultrasonic cleaning step 312 may last for a varying durations ranging from 1 minute to 10 minutes, however, preferably, it comprises ultrasonically cleaning the electrode for at least ten minutes, with the electrode being rotated every five minutes. During the ultrasonic cleaning step 312, UPW should be pumped directly into the liner, with the excess overflowing the line.

In one embodiment, after the ultrasonic cleaning step 312, the electrode may undergo a pre-acid rinsing step 314. In one embodiment, the pre-acid rinsing step 314 comprises spray rinsing the electrode with UPW. Preferably, the pre-acid rinsing step 314 lasts at least one minutes, but other times are contemplated.

Referring to FIG. 7, after the pre-acid rinsing step 314 is completed, the electrode may mounted on any suitable fixture 70. For example, see FIGS. 16-18. The electrode may remain in the fixture 70 until it undergoes the bagging step 328. Once the electrode is mounted in the fixture 70, the silicon surface should not be touched. Instead, the carrier handles on the fixture 70 should be used to move and manipulate the part.

Referring again to FIG. 7, after the pre-acid rinsing step 314 is completed, and the electrode is mounted in the fixture 70, the electrode may under an initial UPW rinsing step 316. In one embodiment, the initial UPW rinsing step 316 comprises using a magnum water gun with UPW and $N^2$ to clean both sides of the electrode. Preferably, the initial UPW rinsing step has a duration of at least 8 minutes. However, other rinsing durations and methods are contemplated. In one embodiment, the $N^2$ supplied ranges from 40 to 50 psi. The initial UPW rinsing step 316 may conducted in a variety of rinsing protocols, for example rinsing 3 minutes on top, 2 minutes on bottom, and an additional 3 minutes on top.

After the initial UPW rinsing step 316, the electrode may undergo the mixed acid soaking step 318. In one embodiment, the mixed acid soaking step 318 comprises soaking the electrode in a mixed acid solution comprising a mixture of hydrofluoric acid, nitric acid, acetic acid, and water, an example of which is illustrated in the following table:

| Source Chemical | Bulk Concentration | Volume Ratio | Volume to make 1 liter |
|---|---|---|---|
| Hydrofluoric Acid (HF) | 49% (w/v) | 1 | 10 ml |
| Nitric Acid | 69% (w/v) | 7.5 | 75 ml |
| Acetic Acid (HAc) | 100% | 3.7 | 37 ml |
| Ultra pure Water | 100% | 87.8 | 878 ml |

For the purposes of describing and defining the present invention, it is noted that the volume ratios provided herein refer to parts-per-hundred, such that a volume ratio of 7.5 indicates that the component contributes to 7.5 percent of the entire volume of the solution.

In one embodiment, the mixed acid solution comprises:

hydrofluoric acid at a volume ratio equivalent to an approximately 40%-60% concentration and hydrofluoric acid solution at a volume ratio less than approximately 10;

nitric acid at a volume ratio equivalent to an approximately 60%-80% concentration nitric acid solution at a volume ratio less than approximately 20;

acetic acid at a volume ratio equivalent to an approximately 90%-100% concentration acetic acid solution at a volume ratio less than approximately 10; and water at a volume ratio above approximately 75.

In another embodiment, the mixed acid solution comprises:

approximately 0.5%, by weight, hydrofluoric acid;
approximately 5.3%, by weight, nitric acid;
approximately 3.8%, by weight, acetic acid; and
water.

In yet another embodiment, the mixed acid solution comprises:

approximately 0.45% to approximately 0.55%, by weight, hydrofluoric acid;
approximately 4.8% to approximately 5.8%, by weight, nitric acid;
approximately 3.3% to approximately 4.3%, by weight, acetic acid; and
water.

In another embodiment, mixed acid solution comprises:

approximately 0.4% to approximately 0.6%, by weight, hydrofluoric acid;
approximately 4.3% to approximately 6.3%, by weight, nitric acid;
approximately 2.8% to approximately 4.8%, by weight, acetic acid; and
water.

The mixed acid soaking step 318 may be conducted for a range of durations, but preferably the soaking is conducted for approximately 10 minutes, with the electrode being agitated every few minutes. However, the agitation may continuous, discontinuous, periodic, or aperiodic. In one embodiment, the mixed acid solution should be mixed fresh. In another embodiment, the mixed acid solution may only be used for two electrodes.

After the mixed acid soaking step 318, the electrode may undergo an acid rinsing step 320. In one embodiment, the acid rinsing step 320 comprises using a magnum water gun to rinse both sides of the electrode. Preferably, the acid rinsing step lasts at least 3 minutes, but other rinsing durations and protocols are contemplated. For example, the electrode is rinsed for 1 minute on top, 1 minute on bottom, and 1 minute on top.

After the acid rinsing step 320, the electrode may undergo a post-acid ultrasonic cleaning step 322. In one embodiment, the post acid ultrasonic cleaning step 322 comprises ultrasonically cleaning the electrode in an ultrasonic tank with an ultrasonic power density approximately ranging from 1.5 Watts/$cm^2$ (10 Watts/$in^2$) to 3.0 Watts/$cm^2$ (20 Watts/$in^2$). Preferably, the ultrasonic cleaning lasts for at least ten minutes, with a rotation after five minutes, but other cleaning durations, and rotation protocols may be used. Preferably, the ultrasonic power density should be verified before the electrode is inserted into the liner. In one embodiment, the electrode and fixture 70 are inserted into an ultrasonic tank with a liner. The liner may be made of polypropylene, polyethylene, or other suitable material. In one embodiment, during the post-acid ultrasonic cleaning step 322, UPW may be pumped directly into the liner with the excess overflowing the liner. In another embodiment, the UPW should have a resistivity >2 MΩcm, and the turnover of the UPW in the tank should be >1.5. However, other resistivities and turnover frequencies are contemplated, and may be used in the post-acid ultrasonic cleaning step 322.

After the post-acid ultrasonic cleaning step 322 is completed, the electrode may undergo a pre-bagging magnum rinse step 324. In one embodiment, the pre-bagging magnum rinse step 324 comprises rinsing the electrode with UPW and $N^2$ to rinse both sides of the electrode. Preferably, the $N^2$ is provided at 40-50 psi, but other pressures are contemplated. Preferably, the pre-bagging rinse step 324 is conducted for at least 3 minutes, however, other rinse times may be sufficient.

For example, the pre-bagging magnum rinse step 324 comprises rinsing the top of the electrode for 1 minute; washing the bottom for 1 minute, and washing the top of the electrode for 1 minute. However, other rinsing sequences and durations are contemplated.

After the pre-bagging magnum rinse step 324 is completed, the electrode may undergo a baking step lnposelstartlnpinposelendoselstart326lnposelend. In one embodiment, the baking step 326 comprises baking the electrode in a cleanroom. In one embodiment, the electrode may be baked in a clean room for at least 2 hours at a temperature of 120° C. However, it is contemplated that the electrode may be baked for different durations and different temperatures. Preferably, the mounting screws should be removed from the fixture 70 to prevent water marks, and the excess water should be blown off the surface of the electrode. Preferably, the excess water may be blown off the electrode with 0.1 μm filtered CDA or Nitrogen gas.

After the baking step 326, the electrode may undergo a bagging step. In one embodiment, the bagging step 328 comprises placing the electrode into a cleanroom bag and vacuum heat sealing the cleanroom bag. In one embodiment, the electrode may be placed into a series of cleanroom bags, with each successive bag being vacuum heat sealed before insertion into the next. Preferably, the electrode is cooled before being inserted into the cleanroom bags.

Alternatively, in one embodiment, the electrode may be cleaned using water based process. For example, steps 300-314 may be completed as would be done for the mixed acid process. After the pre-acid rinsing step 314 is completed, the electrode may be processed with steps 326-328, omitting steps 316-324.

In practicing the methodology of the present disclosure, it may be preferable to ensure that the following equipment is available:

- An ultrasonic tank with a power density of 10-20 Watts/inch$^2$ (at 40 kHz) with ultra pure water (UPW) overflow;
- A standard nozzle gun for UPW rinsing;
- A magnum rinsing gun for UPW and $N_2$ cleaning at 40-50 psi;
- A flexicoil air and water hose, model 54635K214 from McMaster Carr;
- A wet bench for UPW rinsing;
- A cleanroom vacuum bag machine;
- A baking oven, class 100 cleanroom compatible;
- A class 1000 cleanroom or better. Class 100 is recommended;
- A PB-500 ultrasonic energy meter;
- Teflon bars may be needed to support electrodes during cooling if there are not enough baking fixtures;
- A Q-III Surface Particle Detector;
- A Dry Ice ($CO_2$) pellet cleaning system (A plastic nozzle is recommended to avoid metal contamination and damage. Recommended nozzles are (1) 6-inch or 9-inch long, 0.125-inch bore, plastic nozzle or (2) 6-inch or 9-inch long, 0.3125" bore plastic nozzle. Wrapping of a metal nozzle in plastic protective tape may be acceptable;
- Ultra pure water with resistivity >18 MΩ·cm at the source;
- A Class 100 knitted polyester cleanroom wipe;
- Aqueous detergent with low metal cation (e.g. Na+ and K+) concentration (<200 ppm);
- Compressed dry nitrogen gas at 40-50 psi with a 0.1 μm filter;
- An Inner cleanroom bag as specified in Lam specification 603-097924-001;
- An Outer cleanroom bag as specified in Lam specification 603-097924-001;
- Class 100 Oak Technical CLV-100 Antistatic vinyl gloves;
- A scrub pad such as 3M-ScotchBrite #7445 (white) or equivalent;
- A Diamond 3.5 inch ScrubDISK®, 1350 grit. or a three inch pointed tip with 1350 Diamond Tip;
- A sheet of Styrofoam to hold electrode when checking or scrubbing backside light up marks;
- Masking tape for protecting critical contact areas on back if diamond pad scrubbing is required;
- A standard nozzle gun for DIW rinsing during polishing and during rinsing;
- A Magnum rinsing gun model 6735K4 for DIW and $N_2$ cleaning at 40-50 psi provided by McMaster Carr;
- A variable speed turntable used for Si electrode polishing;
- A rinsing stand;
- PP or PE tanks to transport inner and outer silicon electrodes in DIW;
- Ultrasonic tank with a power density of 10-20 Watts/inch$^2$ (at 40 kHz) with DIW overflow;
- An instrument to measure surface roughness;
- A dial height gauge with 12 inches vertical range and 0.001 inch precision;
- A granite table for thickness and profile measurements with mylar cover blocks to prevent scratching;
- An ErgoSCRUB 3.5 inch firm handle with hook backing from Foamex Asia;
- An UltraSOLV® Sponge from Foamex Asia;
- A Diamond 3.5 inch ScrubDISK® with the loop, 140, 180, 220, 280, 360, and 800 grit from Foamex Asia;
- A three inch pointed tip with 1350 Diamond Tip from Foamex Asia, PN HT17491;
- 100 percent isopropyl alcohol (IPA), according to SEMI Spec C41-1101A, grade 1 or better;
- Semiconductor grade nitric acid ($HNO_3$), conforming to SEMI Spec. C35-0301, grade 2 or better;
- Semiconductor grade hydrogen fluoride (HF), conforming to SEMI Spec. C28-0301, grade 2 or better;
- Semiconductor grade acetic acid ($CH_3COOH$), conforming to SEMI Spec. C18-0301, grade 1 or better;
- 100 percent isopropyl alcohol (IPA), according to SEMI Spec C41-1101A, grade 2 or better;
- Compressed dry nitrogen gas or clean dry air (CDA) at 40-50 psi with a 0.1 μm filter;
- Class 100 cleanroom nitrile gloves;
- Class 100 Oak Technical CLV-100 Antistatic vinyl gloves.

Figure 14:
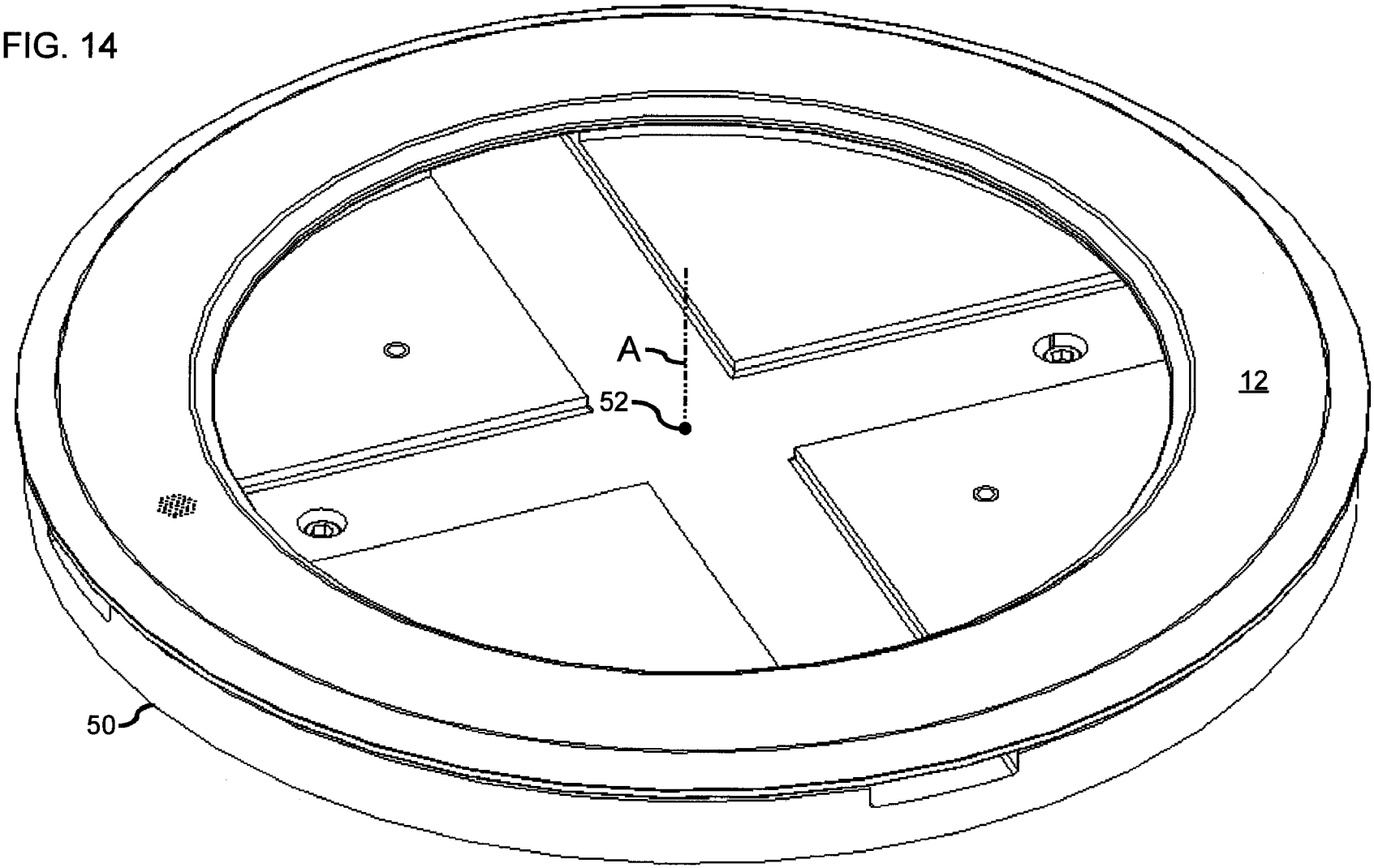
FIG. 14 illustrates a silicon electrode mounted on the electrode platen of FIG. 13.
Figure 15:
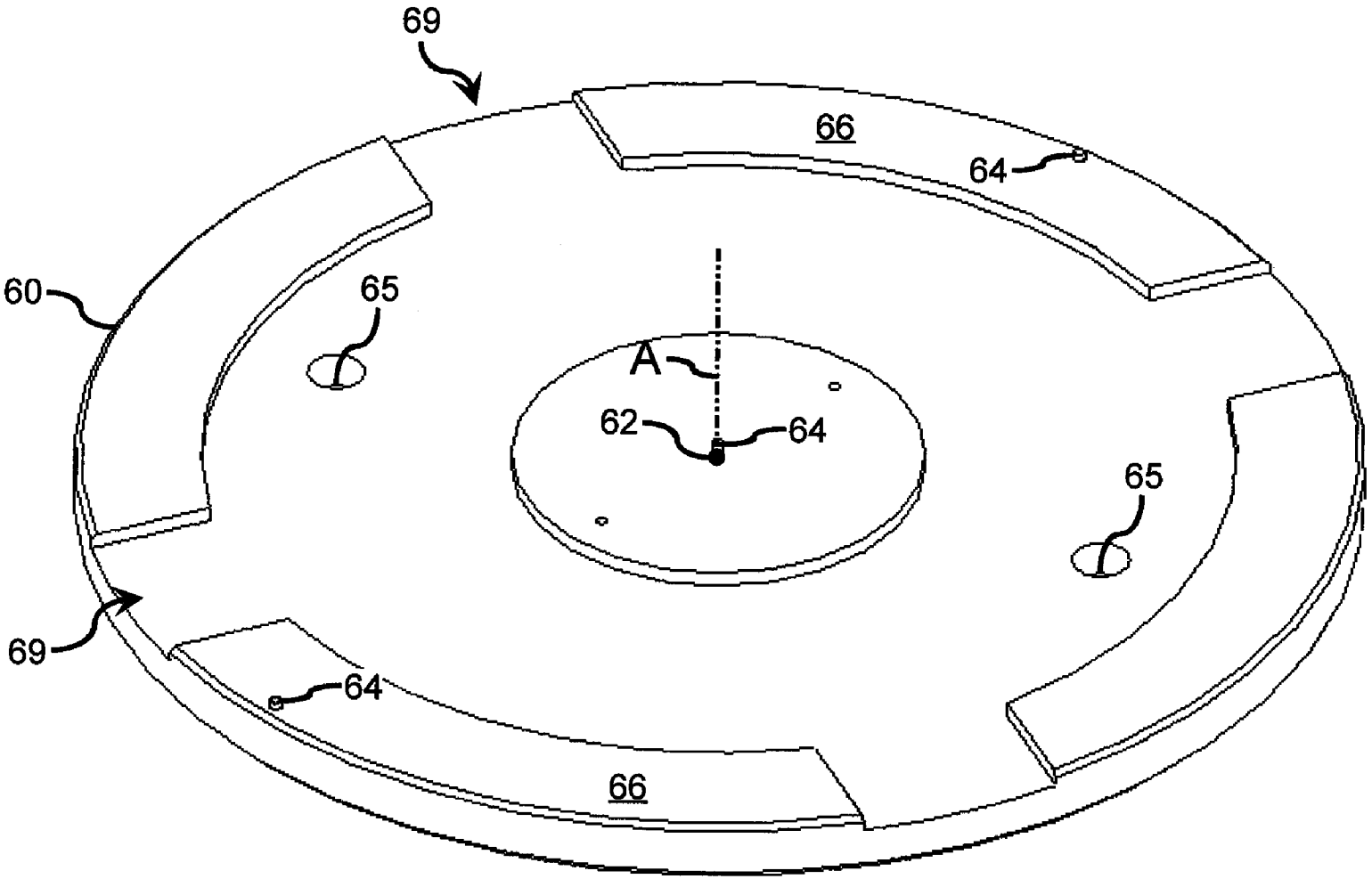
FIG. 15 illustrates a platen adapter according to the present invention.

Referring now to FIGS. 13-15, it is contemplated that the silicon electrode polishing methodology described herein, or any other type of silicon electrode treatment or reconditioning process, may be facilitated with the use of a polishing turntable 15 (see FIGS. 1-5) and a dual function electrode platen 50. As is illustrated schematically in FIGS. 1-5 and 13, the polishing turntable 15 is configured to rotate about a rotary polishing axis A. The dual function electrode platen 50 comprises a platen centroid 52 and is secured to the polishing turntable to bring the platen centroid 52 into approximate alignment with the rotary polishing axis A. In the illustrated embodiment, the electrode platen 50 is secured to the polishing turntable 15 with securing hardware 55 that extends through at least a portion of the thickness of the electrode platen 50 to a threaded engagement with the polishing turntable 15.

The dual function electrode platen 50 further comprises a plurality of axially yielding electrode mounts 54 that are arranged to project from an electrode engaging face 56 of the electrode platen 50. The electrode mounts 54 complement respective positions of axially yielding mount receptacles that are formed in a platen engaging face of the silicon electrode to be mounted on the electrode platen 50. For example, referring to the backside view of the inner and outer electrodes 10, 12 in FIG. 9, the outer electrode 12 comprises a platen engaging face 13A and a plurality of axially yielding mount receptacles 17 that complement the electrode mounts 54.

The axially yielding electrode mounts 54 and the axially yielding mount receptacles 17 are configured to permit non-destructive engagement and disengagement of the electrode engaging face 56 of the electrode platen 50 and the platen engaging face 13A of the silicon electrode 12 in a unitary direction parallel to the rotary polishing axis A. FIG. 14 illustrates the silicon electrode 12 and the electrode platen 50 in the engaged state. To this end, the axially yielding electrode mounts 54 can be designed to comprise an embedded portion 54A that is embedded within a thickness dimension of the electrode platen 50 and a non-threaded portion 54B that projects from the electrode engaging face 56 of the electrode platen 50. The embedded portions 54A of the electrode mounts 54 may be threaded to engage a portion of the electrode platen 50 within the thickness dimension or may merely be designed as a press-fit portion configured to frictionally engage the portion of the electrode platen 50 within the thickness dimension.

Figure 9:
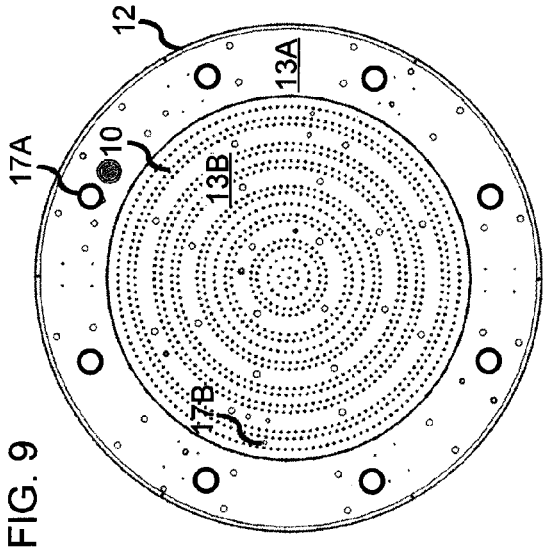

Respective outside diameters (OD) of the non-threaded portions 54B of the electrode mounts 54 can be configured to define respective cylindrical profiles that approximate complementary cylindrical profiles defined by respective inside diameters (ID) of the mount receptacles 17. The degree of OD/ID approximation is typically chosen to be sufficient to secure the silicon electrode 12 to the electrode platen 50 during polishing while permitting non-destructive engagement and disengagement of the silicon electrode 12 and the electrode platen 50. As is illustrated in FIG. 9, the axially yielding electrode mounts 54 are distributed along a common circumferential portion of the electrode platen.

The silicon electrode 12, when mounted in the manner illustrated in FIG. 14 or another similar unclamped manner, can be polished by utilizing the polishing turntable 15 to impart rotary motion to the engaged silicon electrode 12 and by contacting an exposed face of the silicon electrode 12 with a polishing surface as the silicon electrode 12 rotates about the rotary polishing axis A. For example, and not by way of limitation, the dual function electrode platen 50 may be utilized to execute the polishing methodology described herein.

Typical silicon electrode polishing procedures utilize a high degree of fluid flow to facilitate surface polishing. To account for this, the electrode platen 50 is provided with a plurality of fluid egress channels 59 that extend through an outer circumferential portion of the electrode platen. Preferably, the fluid egress channels 59 extend linearly through the electrode engaging face 56 and the platen adapter abutments 58 from the centroid 52 of the electrode platen 50 through the outer circumferential portion of the electrode platen 50.

As is also illustrated in FIG. 13, the dual function electrode platen 50 further comprises platen adapter abutments 58 that are positioned radially inward of the axially yielding electrode mounts 54. A platen adapter 60 is illustrated in FIG. 15. The platen adapter abutments 58 complement the periphery of the platen adapter 60 and are configured to bring the platen adapter centroid 62 of the platen adapter 60 into approximate alignment with the rotary polishing axis A. To help facilitate the aforementioned alignment, in the illustrated embodiment, the platen adapter abutments 58 are formed along a common circumferential portion of the electrode platen 50 and are positioned about an adapter recess 57 formed in the electrode platen 50.

The platen adapter 60 can be used to polish a dissimilar silicon electrode, such as inner electrode 10, by utilizing the platen adapter abutments 58 in the electrode platen 50 to bring the platen adapter centroid 62 into approximate alignment with the rotary polishing axis A. Suitable adapter securing hardware 65 is used to secure the platen adapter 60 to the electrode platen 50. The platen adapter 60 comprises a plurality of additional axially yielding electrode mounts 64 that are arranged to project from an additional electrode engaging face 66 of the platen adapter 60. The respective positions of the electrode mounts 64 complement respective positions of axially yielding mount receptacles that are formed in a platen adapter engaging face of the dissimilar silicon electrode to be mounted on the platen adapter 60. For example, referring to the backside view of the inner and outer electrodes 10, 12 in FIG. 9, the inner electrode 10 comprises a platen adapter engaging face 13B and a plurality of axially yielding mount receptacles 17B that complement the additional electrode mounts 64.

Typically, the electrode platen 50 and the platen adapter 60 are used succession when it is necessary to switch from outer electrode polishing to inner electrode polishing. However, it is contemplated that the electrode platen 50 and the platen adapter 60 may be utilized simultaneously for simultaneous polishing of two dissimilar silicon electrodes.

As is the case with the electrode platen 50, the platen adapter 60 can be secured to the electrode platen with adapter securing hardware 65 that extends through at least a portion of the thickness of the platen adapter to a threaded engagement with the electrode platen. In addition, as is illustrated above with respect to the electrode mounts 54 of FIG. 13, respective ones of the additional axially yielding electrode mounts 64 may comprise threaded or press-fit embedded portions and non-threaded portions that project from the electrode engaging face 66 of the platen adapter 60. The platen adapter 60 further comprises additional fluid egress channels 69 that are arranged to direct fluid to the fluid egress channels 59 of the electrode platen 50.

It is noted that recitations herein of a component of the present disclosure being "configured" or "arranged" in a particular way, "configured" or "arranged" to embody a particular property, or function in a particular manner, are structural recitations, as opposed to recitations of intended use. More specifically, the references herein to the manner in which a component is "arranged" or "configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Rather, the claims appended hereto should be taken as the sole representation of the breadth of the present disclosure and the corresponding scope of the various embodiments described herein. Further, it will be apparent that modifications and variations are possible without departing from the scope of the invention defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A process for cleaning a silicon electrode, the process comprising:

soaking the silicon electrode in an aqueous detergent solution, wherein the aqueous detergent solution comprises metal cations such that the aqueous detergent solution has a metal cation concentration of less than about 200 ppm;

rinsing the silicon electrode with water following removal from the aqueous detergent solution;

soaking the silicon electrode in an isopropyl alcohol (IPA) solution;

rinsing the silicon electrode with water following removal from the IPA solution;

subjecting the silicon electrode to a first ultrasonic cleaning operation in water following removal from the IPA solution;

removing contaminants from the silicon electrode by soaking the silicon electrode in an agitated mixed acid solution comprising hydrofluoric acid, nitric acid, acetic acid, and water and by rinsing the acid-soaked silicon electrode with water;

subjecting the silicon electrode to an additional ultrasonic cleaning operation in water following removal from the mixed acid solution; and rinsing and drying silicon electrode following the additional ultrasonic cleaning operation.

2. A process as claimed in claim 1 wherein a frontside and a backside of the silicon electrode are soaked in the mixed acid solution and the mixed acid solution comprises:

an approximately 49% concentration hydrofluoric acid solution at a volume ratio of approximately 1;

an approximately 69% concentration nitric acid solution at a volume ratio of approximately 7.5;

an approximately 100% concentration acetic acid solution at a volume ratio of approximately 3.7; and water at a volume ratio of approximately 87.8.

3. A process as claimed in claim 1 wherein a frontside and a backside of the silicon electrode are soaked in the mixed acid solution and the mixed acid solution comprises:

hydrofluoric acid at a volume ratio equivalent to an approximately 40%-60% concentration hydrofluoric acid solution at a volume ratio less than approximately 10;

nitric acid at a volume ratio equivalent to an approximately 60%-80% concentration nitric acid solution at a volume ratio less than approximately 20;

acetic acid at a volume ratio equivalent to an approximately 90%-100% concentration acetic acid solution at a volume ratio less than approximately 10; and water at a volume ratio above approximately 75.

4. A process as claimed in claim 1 wherein a frontside and a backside of the silicon electrode are soaked in the mixed acid solution and the mixed acid solution comprises:

approximately 0.5%, by weight, hydrofluoric acid;

approximately 5.3%, by weight, nitric acid;

approximately 3.8%, by weight, acetic acid; and water.

5. A process as claimed in claim 1 wherein a frontside and a backside of the silicon electrode are soaked in the mixed acid solution and the mixed acid solution comprises:

approximately 0.45% to approximately 0.55%, by weight, hydrofluoric acid;

approximately 4.8% to approximately 5.8%, by weight, nitric acid;

approximately 3.3% to approximately 4.3%, by weight, acetic acid; and water.

6. A process as claimed in claim 1 wherein a frontside and a backside of the silicon electrode are soaked in the mixed acid solution and the mixed acid solution comprises:

approximately 0.4% to approximately 0.6%, by weight, hydrofluoric acid;

approximately 4.3% to approximately 6.3%, by weight, nitric acid;

approximately 2.8% to approximately 4.8%, by weight, acetic acid; and water.

7. A process as claimed in claim 1 wherein the agitated mixed acid soak is preceded by an electrode fixturing operation and a water gun rinse with $N_2$ at 40-50 psi on both major faces of the silicon electrode.

8. A process as claimed in claim 1 wherein the aqueous detergent soak is preceded by $CO_2$ pellet cleaning.

9. A process as claimed in claim 1 wherein the first ultrasonic cleaning operation is executed in a water reservoir and is followed by a water gun rinse with $N_2$.

10. A process as claimed in claim 1 wherein the ultrasonic power density of the de-ionized water used in the first ultrasonic cleaning operation is between approximately 1.5 Watts/$cm^2$ (10 Watts/$in^2$) and approximately 3.0 Watts/$cm^2$ (20 Watts/$in^2$) at approximately 40kHz.

11. A process as claimed in claim 1 wherein the additional ultrasonic cleaning operation is characterized by a water resistivity of at least approximately 2 MΩ-cm.

12. A process as claimed in claim 1 wherein the additional ultrasonic cleaning operation is followed by a blow dry operation, a bake operation, and a bagging operation.

13. A process as claimed in claim 12 wherein the bake operation is executed at a temperature of approximately 120° C. for a duration of approximately 2 hours.

14. A process as claimed in claim 1 wherein the rinsing that follows the additional ultrasonic cleaning operation is executed with a water gun rinse with $N_2$ at 40-50 psi on both major faces of the silicon electrode.

15. A process as claimed in claim 1 wherein the aqueous detergent solution, the IPA solution, or both are agitated periodically.

16. A process as claimed in claim 1 wherein soaking operations according to the process are executed by supporting immersed silicon electrodes with polytetrafluoroethylene, polytetrafluoroethylene-coated, or polytetrafluoroethylene encapsulated bars.

17. A process as claimed in claim 1 wherein water utilized to rinse the silicon electrode in the process has a purity characterized by an electrical resistivity of greater than 18 MΩ-cm.

18. A process for cleaning a silicon electrode, the process comprising:

soaking the silicon electrode in an aqueous detergent solution, wherein the aqueous detergent solution comprises metal cations such that the aqueous detergent solution has a metal cation concentration of less than about 200 ppm;

rinsing the silicon electrode with water following the detergent soaking operation;

subjecting the silicon electrode to an ultrasonic cleaning operation in water prior to soaking the silicon electrode in an agitated mixed acid solution comprising hydrofluoric acid, nitric acid, acetic acid, and water;

rinsing the acid-soaked silicon electrode with water;

subjecting the silicon electrode to an additional ultrasonic cleaning operation in water following removal from the mixed acid solution; and rinsing and drying silicon electrode following the additional ultrasonic cleaning operation.

19. A process as claimed in claim 18 wherein a frontside and a backside of the silicon electrode are soaked in the mixed acid solution and the mixed acid solution comprises:

hydrofluoric acid at a volume ratio equivalent to an approximately 40%-60% concentration hydrofluoric acid solution at a volume ratio less than approximately 10;

nitric acid at a volume ratio equivalent to an approximately 60%-80% concentration nitric acid solution at a volume ratio less than approximately 20;

acetic acid at a volume ratio equivalent to an approximately 90%-100% concentration acetic acid solution at a volume ratio less than approximately 10; and water at a volume ratio above approximately 75.

20. A process as claimed in claim 18 wherein a frontside and a backside of the silicon electrode are soaked in the mixed acid solution and the mixed acid solution comprises:

approximately 0.4% to approximately 0.6%, by weight, hydrofluoric acid;

approximately 4.3% to approximately 6.3%, by weight, nitric acid;

approximately 2.8% to approximately 4.8%, by weight, acetic acid; and water.

21. A process as claimed in claim 18, further comprising:

soaking the silicon electrode in an isopropyl alcohol (IPA) solution; and rinsing the silicon electrode with water following the IPA soaking operation.

* * * * *